US009506328B2

(12) United States Patent
Lehrling

(10) Patent No.: US 9,506,328 B2
(45) Date of Patent: Nov. 29, 2016

(54) PRODUCTION FILTERING SYSTEM AND METHODS

(71) Applicant: HALLIBURTON ENERGY SERVICES, INC., Houston, TX (US)

(72) Inventor: Gunnar Lehrling, Newfoundland (CA)

(73) Assignee: Halliburton Energy Services, Inc., Houston, TX (US)

( * ) Notice: Subject to any disclaimer, the term of this patent is extended or adjusted under 35 U.S.C. 154(b) by 125 days.

(21) Appl. No.: 14/372,150

(22) PCT Filed: Jul. 24, 2013

(86) PCT No.: PCT/US2013/051833
§ 371 (c)(1),
(2) Date: Jul. 14, 2014

(87) PCT Pub. No.: WO2015/012821
PCT Pub. Date: Jan. 29, 2015

(65) Prior Publication Data

US 2016/0032693 A1 Feb. 4, 2016

(51) Int. Cl.

| | |
|---|---|
| ***E21B 43/08*** | (2006.01) |
| ***E21B 33/12*** | (2006.01) |
| ***E21B 17/04*** | (2006.01) |
| ***E21B 17/10*** | (2006.01) |
| ***E21B 17/042*** | (2006.01) |

(52) U.S. Cl.
CPC ..... *E21B 43/086* (2013.01); *E21B 17/042* (2013.01); *E21B 17/1078* (2013.01); *E21B 33/12* (2013.01); *E21B 33/1208* (2013.01); *E21B 43/08* (2013.01); *E21B 43/082* (2013.01); *E21B 43/088* (2013.01)

(58) Field of Classification Search
CPC ... E21B 43/086; E21B 43/082; E21B 43/088
See application file for complete search history.

(56) References Cited

U.S. PATENT DOCUMENTS 1,547,240 A * 7/1925 Steele ..... E21B 34/06 166/158
2,401,035 A * 5/1946 Akeyson ..... E21B 43/082 166/205
2,913,051 A * 11/1959 Lister ..... E21B 41/00 166/227
3,216,497 A * 11/1965 Howard ..... E21B 43/04 166/278
3,710,862 A * 1/1973 Young ..... E21B 23/06 166/131
3,768,557 A * 10/1973 Spurlock ..... E21B 43/082 166/228
4,018,283 A * 4/1977 Watkins ..... E21B 43/045 166/233
4,510,996 A * 4/1985 Hardin ..... B01D 29/15 166/227
4,750,557 A * 6/1988 Gavranovic ..... E21B 43/088 166/157
5,330,003 A * 7/1994 Bullick ..... E21B 34/12 166/205
5,443,121 A * 8/1995 Saucier ..... E21B 43/045 166/205
5,474,131 A * 12/1995 Jordan, Jr. ..... E21B 7/061 166/313

(Continued)

OTHER PUBLICATIONS

International Search Report and Written Opinion for related International Application No. PCT/US13/051833, dated Apr. 18, 2014, 10 pages.

*Primary Examiner* — Jennifer H Gay
(74) *Attorney, Agent, or Firm* — Chamberlain Hrdlicka

(57) ABSTRACT

Systems and methods for filtering a production stream downhole that involves creating a basepipe annulus and a casing annulus and forcing the production stream through a filter between the casing annulus and the basepipe annulus before combining the production stream with a previously filtered production stream. Other systems and methods are disclosed.

27 Claims, 4 Drawing Sheets

(56) References Cited

U.S. PATENT DOCUMENTS 5,505,260 A * 4/1996 Andersen ..... E21B 17/1014 166/100
5,617,919 A * 4/1997 Saucier ..... E21B 43/045 166/205
5,715,891 A * 2/1998 Graham ..... E21B 7/061 166/117.6
5,787,985 A * 8/1998 Oneal ..... E21B 27/02 166/205
5,845,712 A * 12/1998 Griffith, Jr. ..... E21B 33/12 166/278
5,947,200 A * 9/1999 Montgomery ..... E21B 43/26 166/281
5,975,205 A * 11/1999 Carisella ..... E21B 43/045 166/134
6,155,342 A * 12/2000 Oneal ..... E21B 27/02 166/205
6,227,303 B1 * 5/2001 Jones ..... E21B 43/04 166/231
6,595,295 B1 7/2003 Berry et al.
6,607,031 B2 * 8/2003 Lynde ..... E21B 37/00 166/205
6,712,148 B2 * 3/2004 Fipke ..... E21B 43/26 166/381
6,976,542 B2 * 12/2005 Henriksen ..... E21B 34/08 166/321
7,104,324 B2 * 9/2006 Wetzel ..... E21B 47/09 166/250.11
7,441,604 B2 * 10/2008 Green ..... E21B 41/0035 166/308.1
8,286,708 B2 * 10/2012 Assal ..... E21B 7/061 166/117.6
8,857,518 B1 * 10/2014 Tips ..... E21B 33/124 166/313
2003/0188871 A1 * 10/2003 Dusterhoft ..... E21B 33/124 166/308.2
2003/0221834 A1 12/2003 Hess et al.
2005/0072576 A1 * 4/2005 Henriksen ..... E21B 34/08 166/386
2009/0025923 A1 * 1/2009 Patel ..... E21B 43/045 166/51
2009/0218101 A1 9/2009 Langlais et al.
2010/0089588 A1 4/2010 Thompson
2010/0139909 A1 * 6/2010 Tirado ..... E21B 43/08 166/51
2010/0163235 A1 * 7/2010 Mootoo ..... E21B 43/045 166/278
2010/0294512 A1 * 11/2010 Assal ..... E21B 7/061 166/384
2012/0111558 A1 5/2012 Knobloch et al.
2013/0306313 A1 * 11/2013 Geoffroy ..... E21B 43/04 166/278
2015/0176378 A1 * 6/2015 Ramey, Jr. ..... E21B 43/08 166/386

* cited by examiner

PRODUCTION FILTERING SYSTEM AND METHODS

CROSS REFERENCE TO RELATED APPLICATIONS

This application is a national stage entry of PCT Patent Application Number PCT/US13/51833 filed on Jul. 24, 2013 entitled PRODUCTION FILTERING SYSTEMS AND METHODS, the entire teachings of which are incorporated herein.

FIELD

The present disclosure relates generally to the production of hydrocarbons and more particularly to the systems and methods for filtering production streams such as open-hole, lateral bore production streams.

BACKGROUND

Crude oil and natural gas occur naturally in subsurface deposits. After such deposits are located in commercial amounts, a well is drilled to develop the resources. Once the drilling process is finished, the well is completed. Completion involves the process of installing equipment and making preparations to produce the oil or gas from the well. Throughout the entire process, enhanced efficiencies are important.

DETAILED DESCRIPTION OF ILLUSTRATIVE EMBODIMENTS

Figure 1:
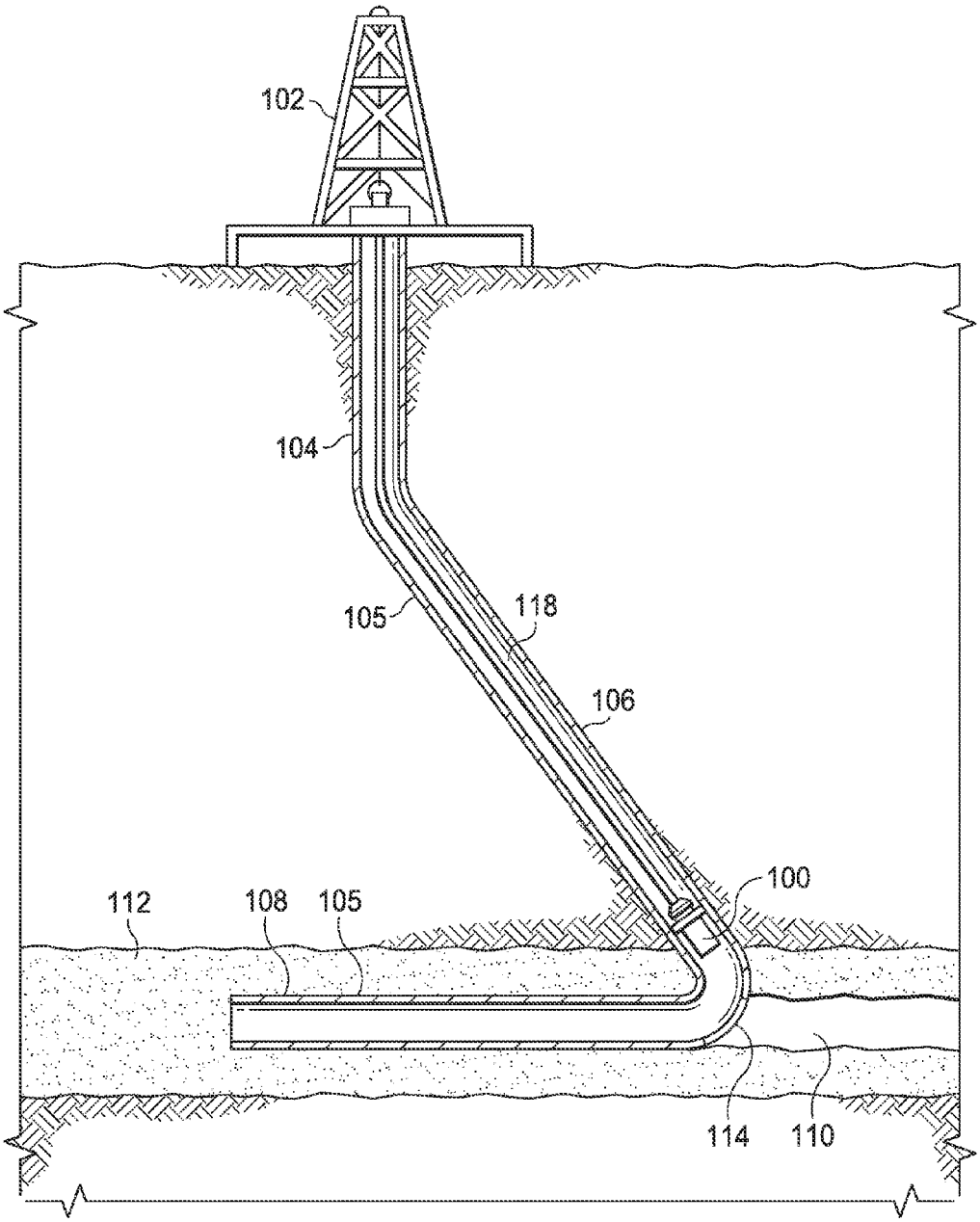
FIG. 1 is a schematic cross-section of a horizontal well having two laterals (a cased mainbore and an open-hole lateral) and utilizing an illustrative embodiment of a system for filtering a production stream.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The term "zone" or "pay zone" as used herein refers to separate parts of the wellbore designated for treatment or production and may refer to an entire hydrocarbon formation or separate portions of a single formation such as horizontally or vertically spaced portions of the same formation. Unless otherwise indicated, as used throughout this document, "or" does not require mutual exclusivity.

As used herein, the term "zonal isolation tool" will be used to identify any type of device operable to control the flow of fluids or isolate pressure zones within a wellbore, including but not limited to a bridge plug, a fracture plug, and a packer (including without limitation swell packers). The term zonal isolation tool may be used to refer to a permanent device or a retrievable device.

As used herein, the terms "seal", "sealing", "sealing engagement" or "hydraulic seal" are intended to include a "perfect seal", and an "imperfect seal. A "perfect seal" may refer to a flow restriction (seal) that prevents all fluid flow across or through the flow restriction and forces all fluid to be redirected or stopped. An "imperfect seal" may refer to a flow restriction (seal) that substantially prevents fluid flow across or through the flow restriction and forces a substantial portion of the fluid to be redirected or stopped.

The various characteristics mentioned above, as well as other features and characteristics described in more detail below, will be readily apparent to those skilled in the art with the aid of this disclosure upon reading the following detailed description of the embodiments, and by referring to the accompanying drawings.

Referring now to the drawings and initially to FIG. 1, a system 100 for filtering a production stream is presented in the context of a horizontal well 102. The horizontal well 102 has a vertical portion 104, a tangent portion 106, a first lateral section or bore 108, which is actually part of a mainbore 105, and a second lateral section or bore 110. The bores 108 and 110 extend along the payzone or target parallel to the reservoir 112. A lateral or lateral bore is any substantially horizontal branch drilled out from a motherbore, the original vertical well, or other central portion of the wellbore. At least several laterals can be drilled from one well. The well 102 further includes a junction 114 at the heel of the two laterals 108, 110. The mainbore 105 is formed by bores 104, 106, and 108. The second lateral 110 and any other laterals are drilled from the mainbore 105. There are several junction designs possible, e.g., drilling out of the casing, having a pre-milled window installed, or other technique. The second lateral 110 is shown approximately horizontal, but it should be understood that the second lateral (and other laterals) may assume a variety of angles with respect to the mainbore 105.

The system 100 is shown downstream of the junction 114. While system 100 will be explained in the context of well 102, it should be understood that the system 100 could be used with any multi-lateral well and that the system 100 may be located in various locations along motherbore 118. Furthermore, the system 100 may also be used offshore or in other environments. The system 100 is typically upstream of sensitive components that may be subject to wear if exposed to an unfiltered production stream for an extended time. For example, sand and debris may erode holes within a flow control device over time and after a number of years might even damage the whole pipe.

Figure 2:
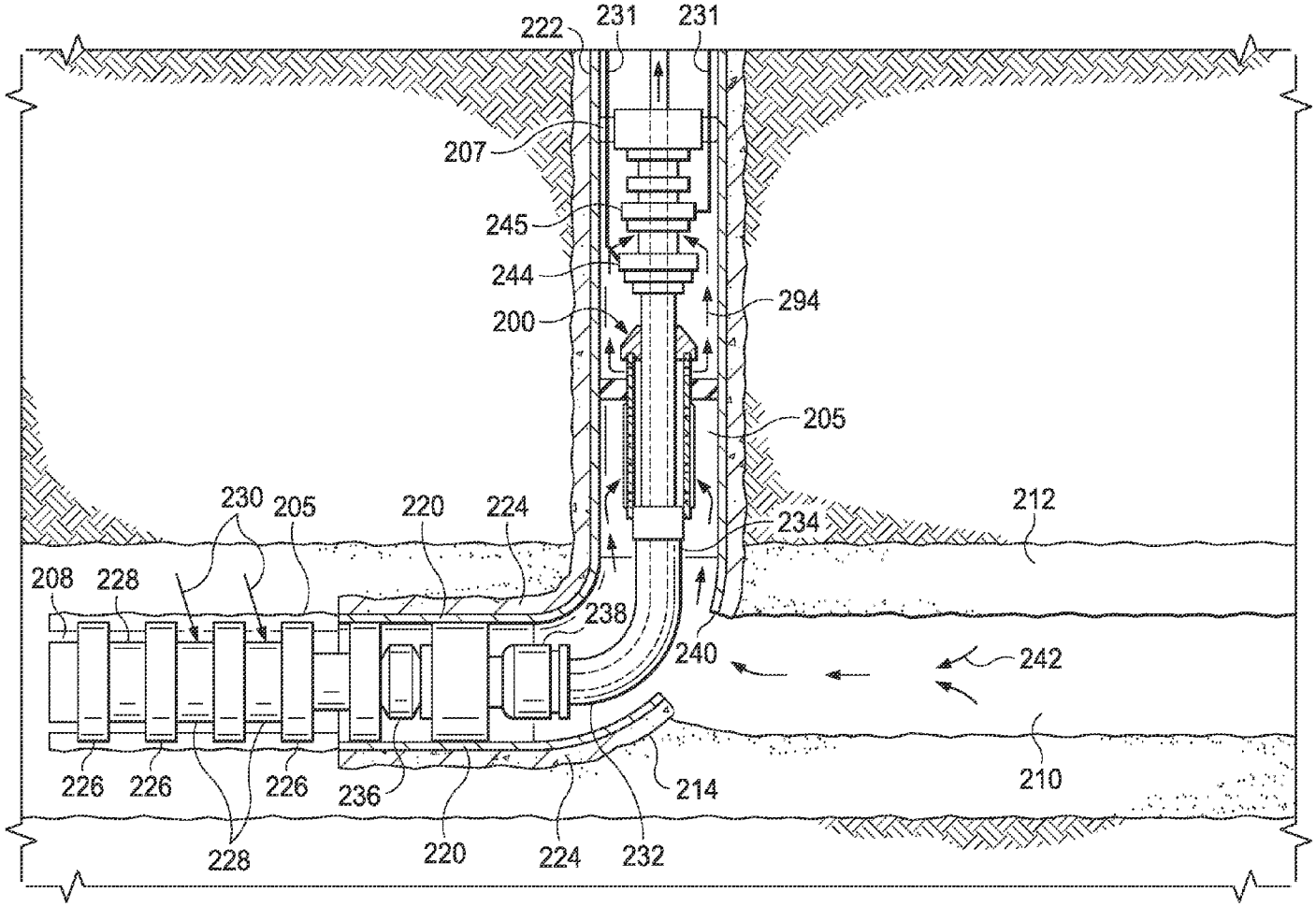
FIG. 2 is a schematic diagram of a well showing an intersection between a motherbore, a first completed lateral bore (part of mainbore), and an open-hole lateral bore and utilizing an illustrative embodiment of a system for filtering a production stream.

Referring now primarily to FIG. 2, a system 200 for filtering a product stream, which is analogous to system 100, is shown proximate a junction 214 where a first lateral section or bore 208 (part of the mainbore 205) and a second lateral section or bore 210, which is in payzone 212, come together with a mainbore 205. The subterranean portions are shown in cross-section as well as some of the production equipment. The first lateral bore 208 is shown completed with various production details. Thus, at least a portion of the first lateral bore 208 has a casing 220 that extends from the first lateral bore 208 to the main bore 205 and to the surface. Cement 224 is disposed between the outer wall of the casing 220 and the wellbore diameter.

The various production components in the first lateral bore 208 are for illustration purposes and may include a plurality of zonal isolation tools, e.g., swell packers 226, and a plurality of screens 228. As suggested by arrows 230, a production stream from the first lateral bore 208 flows through the plurality of screens 228 to produce a filtered production stream. The filtered production stream flows in production string or tubing 232 and into the portion that is the tailpipe 234. Other equipment may be included in the first lateral bore 208, which is part of the mainbore 205, such as one or more inflow control valves (ICV), interval control valve 236, pumps, seal assembly 238, etc.

Proximate junction 214, the casing 220 has a casing window 240 that provides access from the second lateral bore 210 to the main bore 205. In this instance, an unfiltered production stream shown by arrows 242 is delivered into the main bore 205 external to the production tubing 232. The system 200 filters this second production stream before introducing that filtered stream or combining that stream with the previously filtered production stream of the first lateral bore 238. The system 200 forces the unfiltered production stream 242 from the second lateral bore 210 through a filter as will be described further below. The system 200 accomplishes the filtering upstream of production equipment that may be prone over the long-term to wear from debris and sand. For example, the system 200 may be located upstream of an inflow control valve 244 for the mainbore 205 and an inflow control valve 245 for the lateral. The upstream inflow control valve 244 receives the previously filtered stream and the downstream inflow control valve 245 receives the filtered stream produced by system 200. One or more feed-through packers 207 may be included downstream of the system 200. One or more control lines 231 may be included that control valves 244 and 245. The combined production streams (from first lateral 208 portion of mainbore 205 and second lateral 210) can then flow through the production tubing 232 to the surface.

Figure 3:
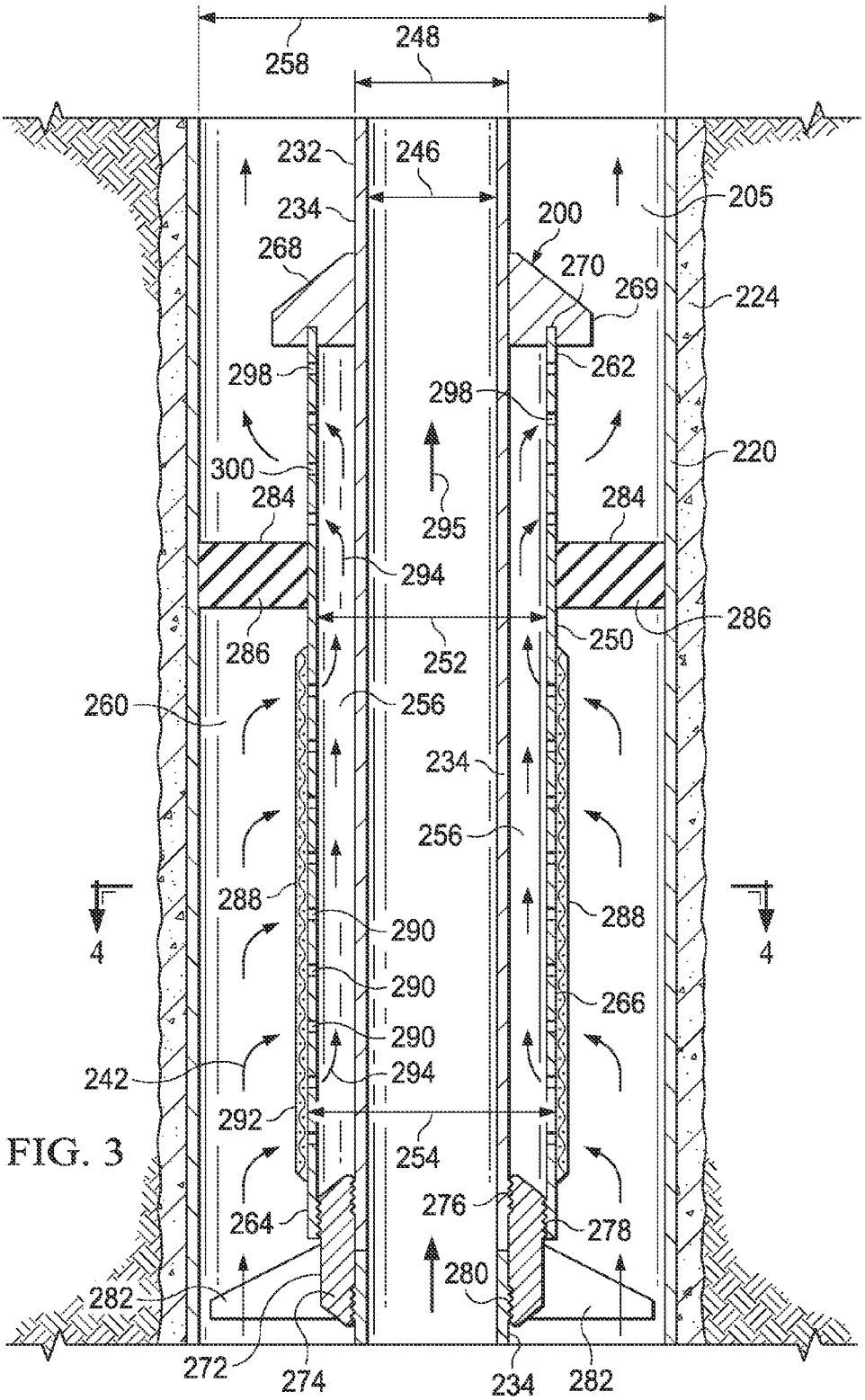
FIG. 3 is a schematic cross-section of an illustrative embodiment of a system for filtering a production stream in the annulus between production tubing and casing prior to introduction to a second filtered production stream.
Figure 4:
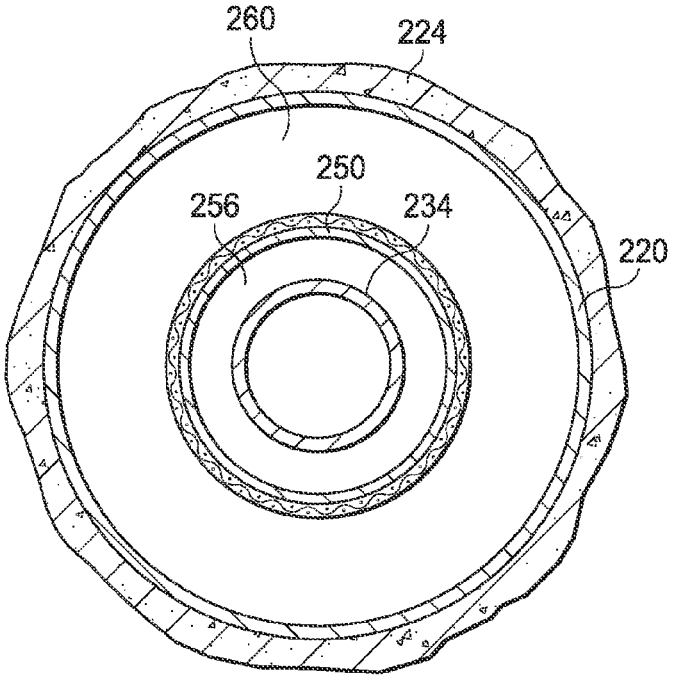
FIG. 4 is a schematic cross-section taken along line 4-4 of FIG. 3.

Referring now primarily to FIGS. 3 and 4, an illustrative embodiment of the system 200 is presented. The system 200 is positioned along the production tubing 232, and in particular, along the lower tailpipe 234. The tailpipe 234 has an inside diameter 246 and an outside diameter 248. The tailpipe 234 couples to or otherwise forms a portion of the production tubing or production string 232. The tailpipe 234 is disposed within the main bore 205 radially inward from the casing 220. For the perspective shown in FIG. 3, the top is downstream from the bottom portion.

The system 200 includes a base pipe 250 having an inside diameter 252 and an outside diameter 254. The base pipe inside diameter 252 is greater than the tailpipe outside diameter 248 by an amount that creates a base pipe annulus 256. The base pipe outside diameter 254 is less than an inside diameter 258 of the casing 220 by an amount that creates a casing annulus 260. The base pipe 250 has a first end 262, or downstream end, and a second end 264, or upstream end. The base pipe 250 has a medial portion 266 between the first end 262 and the second end 264. The base pipe 250 may be shorter in length than one joint or may be longer than one joint depending on the desired length and the amount of filtering desired.

A first tailpipe attachment device 268 surrounds the tailpipe 234 proximate to the first end 262 of the base pipe 250. The first tail pipe attachment device 268 holds the first end 262 of the base pipe proximate to the tailpipe 234 downstream from the second end 264. The first tailpipe attachment device 268 may be, for example, an end cap with grooves 270 for receiving the extreme end of the first end 262 of the base pipe 250. The extreme end of first end 262 may be screwed on threads or welded within the groove 270 or otherwise attached. The first tailpipe attachment device 268 may have an optional enlarged portion 269 with an outside diameter that is close to the inside diameter of the casing 220, e.g., 80%, 90%, or more of the inside diameter of the casing 220 or any value in between. The first tailpipe attachment device 268 may include fins or other enlarged portions that extend to or near the casing 220 to serve as a centralizer to center the system 200 within the bore.

A second tailpipe attachment device 272 is coupled to the second end 264 of the base pipe 250 and to the tailpipe 234. The second tailpipe attachment device 272 forms an upstream seal that is substantially fluid-tight. The upstream seal is at an upstream end of the base pipe annulus 256. The second tailpipe attachment device 272 may be, for example, a three-way adapter 274, or may be a weld or other coupling device. A three-way adapter 274 has internal threads 276 on an internal edge that couple with the tailpipe 234 or a portion of it. The first end of the second tailpipe attachment device 272 includes second, or external, threads 278 for coupling with threads on the second end of the base pipe 250. The three-way adapter 274 may further include bottom threads 280 for coupling with another portion of tailpipe 234. In other words, the three-way adapter 274 may be used to connect joints on the tailpipe 234. The second tailpipe attachment device 272 may further include at least a portion having an expanded diameter to touch or to come close to the casing 220 and thereby centralize the tailpipe 234 or base pipe 250 within the casing 220. For example, a plurality of fins 282 may be included or other aspect.

A flow diverter 284 is coupled to the base pipe 250. The flow diverter 284 is coupled to an exterior of the base pipe 250 for substantially sealing flow in the casing annulus 260 at or near the flow diverter 284. The flow diverter 284 may be any device capable of forming a seal or otherwise diverting the fluid flow. For example, the flow diverter 284 may be a swell packer 286, but again any other device that is capable of diverting the fluid could be used.

A filter 288 is formed (made or disposed) on medial portion 266 of the base pipe 250 for filtering the production stream 242 from the open hole lateral bore 210 or other location such as flow from another perforated payzone. The production stream 242 is filtered as it travels across a filter 288 or screen from the case annulus 260 to the base pipe annulus 256. The filter 288 may comprise, for illustrative purposes, a plurality of filter apertures 290 covered by a filter material 292 such as a wire mesh, wire wrap, pre-packed, coiled wire or other filtering material. The filter 288 is positioned upstream of the flow diverter 284. This forces the flow of the unfiltered production stream 242 through the screen 288 to create a second filtered production stream 294 that will be combined with the first filtered stream 295.

A plurality of return apertures 298 provides a flow path for fluidly coupling the base pipe annulus 256 with the casing annulus 260 downstream of the flow diverter 284. The plurality of return apertures 298 allow the second filtered production stream 294 to continue in the casing annulus 260. As shown in FIG. 2, the second filtered production stream 294 may then enter the tailpipe and continue to the surface through the production tubing 232. The plurality of return apertures 298 may comprise cutouts 300 in the wall of the base pipe 250 or through the first tailpipe attachment device 268 as presented below.

Figure 5:
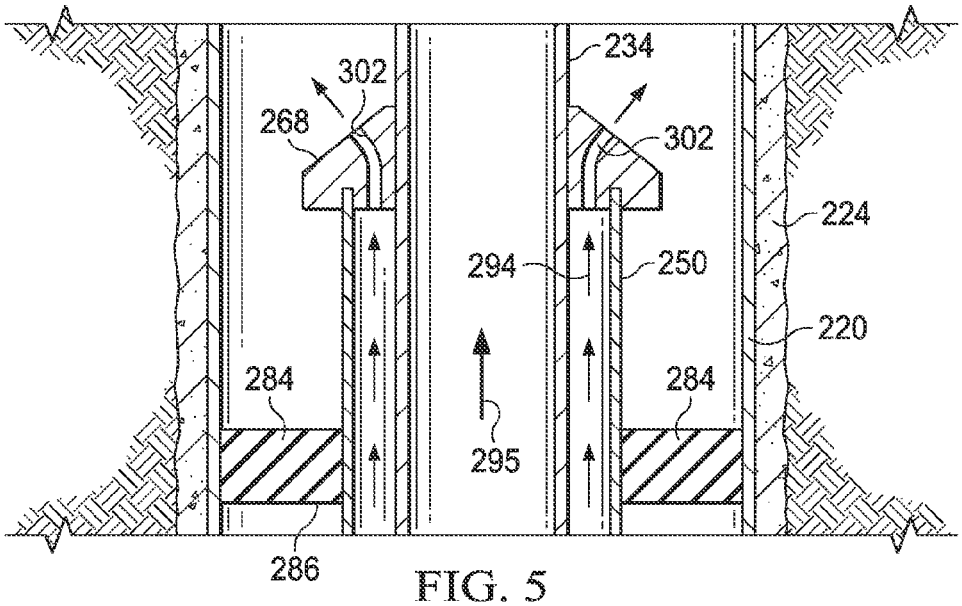
FIG. 5 is a schematic cross-section of a portion of an illustrative embodiment of a system for filtering a production stream prior to introduction to a second filtered production stream.

Referring now primarily to FIG. 5, a portion of the system 200 for filtering a product stream is shown that is analogous or identical to that of FIGS. 3-4, except another illustrative embodiment of return apertures 298 is presented. In this embodiment, the return apertures 298 include a flow channel or pathway 302 formed in the first tailpipe attachment device 268. Some combination of flow paths 302 in the first tailpipe attachment device 268 or cutouts 300 in the base pipe 250 may also be used or any technique for introducing the flow into the casing annulus 260.

The system and methods herein do not require extra junctions to use. The methods and systems allow for multi-lateral wells to be drilled with at least one lateral remaining open, and this may allow for a greater savings of time and may reduce the complexity of the well.

According to an illustrative embodiment, a system for filtering a production stream radially exterior to a tailpipe and radially interior to a casing in order to produce a first filtered production stream for introduction into the tailpipe having a second filtered production stream includes the tailpipe having a tailpipe inside diameter and a tailpipe outside diameter. The tailpipe is for coupling to a lower end of a production stream and for disposing within a well casing having a casing inside diameter. The system further includes a basepipe having a basepipe inside diameter and a basepipe outside diameter. The basepipe inside diameter is greater than the tailpipe outside diameter to create a basepipe annulus. The basepipe outside diameter is less than the casing inside diameter to create a casing annulus. The basepipe has a first end and a second end and a medial portion between the first end and second end. The system also includes a first tailpipe attachment device and a second tailpipe attachment device. The second tailpipe attachment device is coupled to the second end of the basepipe and to the tailpipe to create a seal at one end of the basepipe annulus. The first tailpipe attachment device is for centering the first end of basepipe. The system further includes a flow diverter coupled to an exterior of the basepipe for substantially sealing flow in the casing annulus; a plurality of filter apertures formed on the medial portion of the basepipe upstream of the flowed diverter; a screening device coupled over the plurality of apertures to create a filter on the basepipe; and a plurality of return apertures for fluidly coupling the base annulus with the casing annulus downstream of the flow diverter.

Numerous variations, permutations, and combinations of the embodiment of the preceding paragraph are possible. For example, in one embodiment, the second tailpipe attachment device includes a three-way adapter with interior threads on two ends for coupling tailpipe segments and external threads for coupling to the basepipe. In another example, the second tailpipe attachment device includes a three-way adapter with interior threads on two ends for coupling tailpipe segments and external threads for coupling to the basepipe; and further includes an enlarged portion to centralize the tailpipe within the casing. In another example still, the second tailpipe attachment device includes a welded segment. In another example, the first tailpipe connection includes an end-cap proximate to an exterior of the tailpipe and coupled to the first end of the basepipe. In another example, the first tailpipe connection includes an end-cap proximate to an exterior of the tailpipe and coupled to the first end of the basepipe, and wherein the end-cap is formed with an plurality of flow channels and wherein the flow channels comprise at least a portion of the plurality of return apertures.

In still another example, the first tailpipe connection includes an end-cap proximate to an exterior of the tailpipe and coupled to the first end of the basepipe, wherein the first tailpipe connection has at least a portion with an outside diameter large enough to centralize the tailpipe and basepipe within the casing. In another example, the first tailpipe connection includes an end-cap proximate to an exterior of the tailpipe and coupled to the first end of the basepipe, and wherein the first tailpipe connection has at least a portion with an outside diameter large enough to centralize the tailpipe and basepipe within the casing, and wherein the first tailpipe connection has at a least a portion with an outside diameter that is at least 90% of the inside diameter of the casing. In another example, the flow diverter includes a swell packer. In another example, the screen device includes a wire wrapping over the plurality of filter apertures. In another example, the plurality of return apertures include a plurality of apertures formed through the basepipe downstream of the flow diverter. In another example, the basepipe is longer than one joint. In another example, the system also includes a plurality of fins coupled to the second tailpipe attachment device for centering the basepipe and tailpipe in the casing annulus.

According to another illustrative embodiment, a system for filtering a production stream before combining with a filtered production stream in a tailpipe includes a basepipe for surrounding at least a portion of the tailpipe. The basepipe has a first end and second end. The basepipe has an inside diameter greater than an outside diameter of the tailpipe whereby a base annulus is created when the basepipe is around the tailpipe and wherein the basepipe has an outside diameter smaller than a well casing inside diameter where when in service a casing annulus is created. The system further includes a first tailpipe attachment device and a second tailpipe attachment device. The second tailpipe attachment device includes a three-way adapter for coupling to an upstream portion of the tailpipe. The first tailpipe attachment device includes an end-cap for disposing about a downstream portion of the tailpipe. The basepipe is coupled to the first tailpipe attachment device. The basepipe is coupled to the second tailpipe attachment device to create an upstream seal to the base annulus. The system further includes a filter formed on an intermediate portion of the basepipe for filtering the production stream as the production stream enters the base annulus through the filter and an isolation tool coupled to a portion of the basepipe and configured so that when the isolation tool is disposed between the basepipe and the casing, the isolation tool is operable to substantially seal a portion of the casing annulus and thereby force the production stream into the filter. The system also includes a plurality of return apertures in the basepipe for directing a filtered production stream from the base annulus to a portion of the casing annulus downstream of the packer. The system may also include a plurality of fins for centering the basepipe within the casing annulus.

According to another illustrative embodiment, a method for filtering an open-hole production stream before the production stream enters the tailpipe includes: using a basepipe to form a base annulus around the portion of the tailpipe and to form a casing annulus between the basepipe and a casing; substantially sealing an upstream end of the base annulus; substantially forming a seal in the case annulus downstream of at least a filtering portion of the basepipe using a flow diverter; providing a filter on the filter portion of the basepipe upstream of the flow diverter for filtering the open-hole production stream as the open-hole production stream goes from the casing annulus to the base annulus; and fluidly coupling the open-hole production stream in the base annulus with the casing annulus downstream of the filter.

Numerous variations, permutations, and combinations of the embodiment of the preceding paragraph are possible. For example, The method may further include centering at least a portion of the basepipe within the casing annulus. As another example, the method may also include attaching a plurality of fins to a portion of the basepipe. As another example, the step of substantially sealing a first end of the base annulus may include applying an endcap around a portion of the tailpipe and coupling the endcap to a first end of the basepipe. As still another example, the step of substantially sealing the upstream end of the base annulus may include applying a three-way adapter on a portion the tailpipe and coupling a downstream end of the basepipe to the three-way adapter. As another example, the step of providing a filter may include forming filter apertures on the filter portion of the basepipe and covering the filter apertures with a filter material. As another example, the step of fluidly coupling the base annulus with the casing annulus may include providing return apertures on the basepipe downstream of the flow diverter. As another example, the step of directing the production stream from the base annulus to the casing annulus downstream of the filter includes forming a return aperture through an endcap.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

It will be understood that the benefits and advantages described above may relate to one embodiment or may relate to several embodiments. It will further be understood that reference to "an" item refers to one or more of those items.

The steps of the methods described herein may be carried out in any suitable order, or simultaneously where appropriate. Where appropriate, aspects of any of the examples described above may be combined with aspects of any of the other examples described to form further examples having comparable or different properties and addressing the same or different problems.

It will be understood that the above description of preferred embodiments is given by way of example only and that various modifications may be made by those skilled in the art. The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

I claim:

1. A system for filtering a production stream radially exterior to a tailpipe and radially interior to a casing in order to produce a first filtered production stream for introduction into the tailpipe having a second filtered production stream, the system comprising:

the tailpipe having a tailpipe inside diameter and a tailpipe outside diameter, the tailpipe for coupling to a lower end of a production stream and for disposing within the casing having a casing inside diameter;

a basepipe having a basepipe inside diameter and a basepipe outside diameter, wherein the basepipe inside diameter is greater than the tailpipe outside diameter to create a basepipe annulus and wherein the basepipe outside diameter is less than the casing inside diameter to create a casing annulus and wherein the basepipe has a first end and a second end and a medial portion between the first end and second end;

a first tailpipe attachment device and a second tailpipe attachment device, wherein the second tailpipe attachment device is coupled to the second end of the basepipe and to the tailpipe to create a fluid seal at one end of the basepipe annulus between the basepipe and the tailpipe, and wherein the first tailpipe attachment device is for centering the first end of basepipe;

a flow diverter coupled to an exterior of the basepipe for substantially sealing flow in the casing annulus;

a plurality of filter apertures formed on the medial portion of the basepipe upstream of the flowed diverter;

a screening device coupled over the plurality of apertures to create a filter on the basepipe; and a plurality of return apertures for fluidly coupling the base annulus with the casing annulus downstream of the flow diverter.

2. The system of claim 1, wherein the second tailpipe attachment device comprises a three-way adapter with interior threads on two ends for coupling tailpipe segments and external threads for coupling to the basepipe.

3. The system of claim 1, wherein the second tailpipe attachment device comprises a three-way adapter with interior threads on two ends for coupling tailpipe segments and external threads for coupling to the basepipe; and further comprising an enlarged portion to centralize the tailpipe within the casing.

4. The system of claim 1, wherein the second tailpipe attachment device comprises a welded segment.

5. The system of claim 1, wherein the first tailpipe attachment device comprises an end-cap proximate to an exterior of the tailpipe and coupled to the first end of the basepipe.

6. The system of claim 1, where the first tailpipe attachment device comprises an end-cap proximate to an exterior of the tailpipe and coupled to the first end of the basepipe, wherein the end-cap is formed with an plurality of flow channels and wherein the flow channels comprise at least a portion of the plurality of return apertures.

7. The system of claim 1, where the first tailpipe attachment device comprises an end-cap proximate to an exterior of the tailpipe and coupled to the first end of the basepipe, wherein the first tailpipe attachment device has at least a portion with an outside diameter large enough to centralize the tailpipe and basepipe within the casing.

8. The system of claim 1, where the first tailpipe attachment device comprises an end-cap proximate to an exterior of the tailpipe and coupled to the first end of the basepipe, wherein the first tailpipe attachment device comprises an outside diameter large enough to centralize the tailpipe and basepipe within the casing, and wherein the first tailpipe attachment device comprises an outside diameter that is at least 90% of the inside diameter of the casing.

9. The system of claim 1, wherein the flow diverter comprises a swell packer.

10. The system of claim 1, wherein the screen device comprises wire wrapping over the plurality of filter apertures.

11. The system of claim 1, wherein the plurality of return apertures comprises a plurality of apertures formed through the basepipe downstream of the flow diverter.

12. The system of claim 1, wherein the basepipe is longer than one joint.

13. The system of claim 1, further comprising a plurality of fins coupled to the second tailpipe attachment device for centering the basepipe and tailpipe in the casing annulus.

14. The system of claim 1, wherein the second tailpipe attachment device comprises a three-way adapter with interior threads on two ends for coupling tailpipe segments and external threads for coupling to the basepipe;

the first tailpipe attachment device comprises an end-cap proximate to an exterior of the tailpipe and coupled to the first end of the basepipe;

the flow diverter comprises a swell packer; and the screen device comprises wire wrapping over the plurality of filter apertures.

15. The system of claim 1, wherein the second tailpipe attachment device comprises a three-way adapter with interior threads on two ends for coupling tailpipe segments and external threads for coupling to the basepipe;

the first tailpipe attachment device comprises an end-cap proximate to an exterior of the tailpipe and coupled to the first end of the basepipe;

the flow diverter comprises a swell packer;

the screen device comprises wire wrapping over the plurality of filter apertures; and the second tailpipe attachment device comprises a three-way adapter with interior threads on two ends for coupling tailpipe segments and external threads for coupling to the basepipe; and further comprising an enlarged portion to centralize the tailpipe and basepipe within the casing.

16. A system for filtering a production stream before combining with a filtered production stream in a tailpipe, the system comprising:

a basepipe for surrounding at least a portion of the tailpipe, the basepipe having a first end and second end, wherein the basepipe has an inside diameter greater than an outside diameter of the tailpipe whereby a base annulus is created when the basepipe is around the tailpipe and wherein the basepipe has an outside diameter smaller than a well casing inside diameter where when in service a casing annulus is created;

a first tailpipe attachment device and a second tailpipe attachment device, wherein the second tailpipe attachment device comprises a three-way adapter for coupling to an upstream portion of the tailpipe, and wherein the first tailpipe attachment device comprises an end-cap for disposing about a downstream portion of the tailpipe;

wherein the basepipe is coupled to the first tailpipe attachment device, and wherein the basepipe is coupled to the second tailpipe attachment device to create an upstream seal to the base annulus;

a filter formed on an intermediate portion of the basepipe for filtering the production stream as the production stream enters the base annulus through the filter;

an isolation tool coupled to a portion of the basepipe and configured so that when the isolation tool is disposed between the basepipe and the casing, the isolation tool is operable to substantially seal a portion of the casing annulus and thereby force the production stream into the filter; and a plurality of return apertures in the basepipe for directing a filtered production stream from the base annulus to a portion of the casing annulus downstream of the packer.

17. The system of claim 16, wherein the second tailpipe attachment device further comprises a plurality of fins for centering the basepipe within the casing annulus.

18. A method for filtering a production stream before the production stream enters a tailpipe, the method comprising:

using a basepipe to form a base annulus around the portion of the tailpipe and to form a casing annulus between the basepipe and a casing;

substantially fluidly sealing an upstream end of the base annulus between the basepipe and the tailpipe;

substantially forming a seal in the casing annulus downstream of at least a filtering portion of the basepipe using a flow diverter;

providing a filter on the filter portion of the basepipe upstream of the flow diverter for filtering the production stream as the production stream goes from the casing annulus to the base annulus; and fluidly coupling the production stream in the base annulus with the casing annulus downstream of the filter.

19. The method of claim 18, further comprising centering at least a portion of the basepipe within the casing annulus.

20. The method of claim 19, further comprising attaching a plurality of fins to a portion of the basepipe.

21. The method of claim 18, further comprising substantially sealing a first end of the base annulus comprising applying an endcap around a portion of the tailpipe and coupling the endcap to a first end of the basepipe.

22. The method of claim 18, wherein the step of substantially fluidly sealing the upstream end of the base annulus comprises applying a three-way adapter on a portion the tailpipe and coupling a downstream end of the basepipe to the three-way adapter.

23. The method of claim 18, wherein the step of providing a filter comprises forming filter apertures on the filter portion of the basepipe and covering the filter apertures with a filter material.

24. The method of claim 18, wherein the step of fluidly coupling the base annulus with the casing annulus comprises providing return apertures on the basepipe downstream of the flow diverter.

25. The method of claim 18, wherein the step of directing the production stream from the base annulus to the casing annulus downstream of the filter comprises forming a return aperture through an endcap.

26. The method of claim 18, further comprising centering at least a portion of the basepipe within the casing annulus; and wherein the step of substantially fluidly sealing the upstream end of the base annulus comprises applying a three-way adapter on a portion the tailpipe and coupling a downstream end of the basepipe to the three-way adapter.

27. The method of claim 18, further comprising centering at least a portion of the basepipe within the casing annulus;

wherein the step of substantially fluidly sealing the an upstream end of the base annulus comprises applying a three-way adapter on a portion the tailpipe and coupling a downstream end of the basepipe to the three-way adapter;

wherein the step of providing a filter comprises forming filter apertures on the filter portion of the basepipe and covering the filter apertures with a filter material; and wherein the step of fluidly coupling the base annulus with the casing annulus comprises providing return apertures on the basepipe downstream of the flow diverter.

* * * * *